US011731149B2

(12) United States Patent
Schroft et al.

(10) Patent No.: US 11,731,149 B2
(45) Date of Patent: Aug. 22, 2023

(54) DEVICE FOR APPLYING A VISCOUS SUBSTANCE

(71) Applicant: Schwan Cosmetics International GmbH, Heroldsberg (DE)

(72) Inventors: Monika Schroft, Heroldsberg (DE); Herbert Brendel, Nuremberg (DE); René Heinlein, Nuremberg (DE)

( * ) Notice: Subject to any disclaimer, the term of this patent is extended or adjusted under 35 U.S.C. 154(b) by 115 days.

(21) Appl. No.: 17/613,830

(22) PCT Filed: Jun. 3, 2020

(86) PCT No.: PCT/EP2020/065281
§ 371 (c)(1),
(2) Date: Nov. 23, 2021

(87) PCT Pub. No.: WO2020/245150
PCT Pub. Date: Dec. 10, 2020

(65) Prior Publication Data

US 2022/0226849 A1 Jul. 21, 2022

(30) Foreign Application Priority Data

Jun. 5, 2019 (DE) ..... 202019002457

(51) Int. Cl.
*A45D 34/04* (2006.01)
*B05B 11/02* (2023.01)
(Continued)

(52) U.S. Cl.
CPC ..... *B05B 11/1026* (2023.01); *A45D 34/04* (2013.01); *B05B 11/0035* (2013.01);
(Continued)

(58) Field of Classification Search
CPC .. A45D 34/04; A45D 2200/056; B43K 5/189; B05B 11/028; B05B 11/0035; B05B 11/1015; B05B 11/1052; B05B 11/1026
See application file for complete search history.

(56) References Cited

U.S. PATENT DOCUMENTS 4,624,594 A 11/1986 Sasaki
4,984,922 A 1/1991 Iizuka
(Continued)

FOREIGN PATENT DOCUMENTS

CN 102203369 A 9/2011
CN 103373543 A 10/2013
(Continued)

OTHER PUBLICATIONS

European Patent Office, International Search Report for International Application No. PCT/EP2020/065281, dated Sep. 7, 2020.
(Continued)

*Primary Examiner* — Patrick M. Buechner
(74) *Attorney, Agent, or Firm* — Bradley Arant Boult Cummings LLP; Alexandra C. Lynn; Timothy L. Capria

(57) ABSTRACT

The invention relates to a device for applying a viscous substance, in particular for cosmetic, writing, painting, drawing and/or marking purposes, having a tank for the substance, an applicator and a conveyor designed to convey the substance from the tank to the applicator. According to the invention, the conveyor has a cylinder, a first and a second closing device, which are both arranged in the cylinder in an axially displaceable manner, a pump tappet for axially displacing the closing devices, a first connecting channel between the cylinder and the tank and a second connecting channel between the cylinder and the applicator, the first closing device opens or closes the first connecting channel depending on its position relative to the cylinder, and the second closing device is adjustable relative to the
(Continued)

Figure 1:
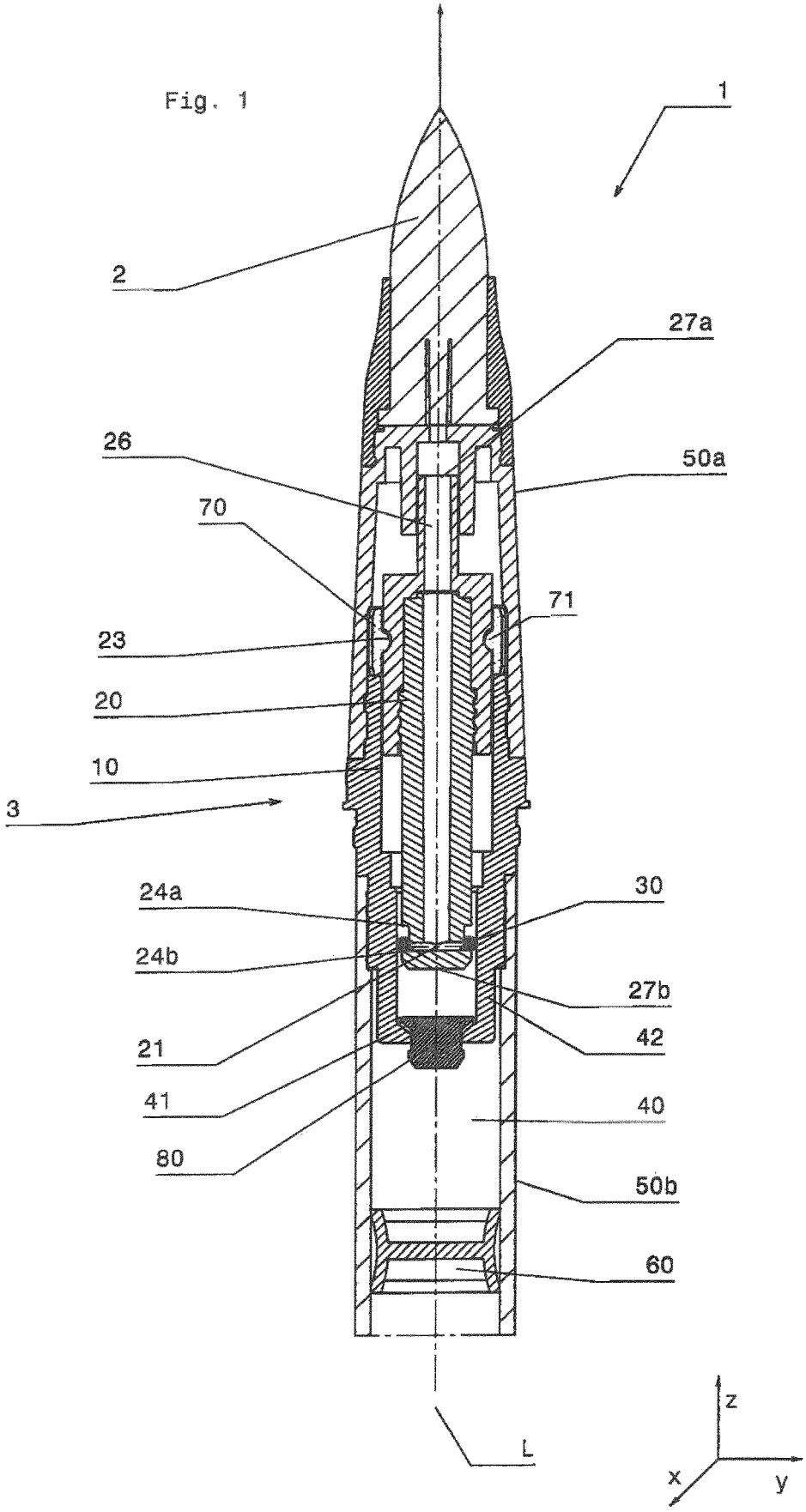

pump tappet, opens or closes the second connecting channel depending on the position relative to the pump tappet and, together with the cylinder, forms a pump in which it serves as a piston.

20 Claims, 18 Drawing Sheets

(51) Int. Cl.
*B05B 11/10* (2023.01)
*B05B 11/00* (2023.01)
*B43K 5/18* (2006.01)

(52) U.S. Cl.
CPC ..... *B05B 11/028* (2023.01); *B05B 11/1015* (2023.01); *B05B 11/1052* (2023.01); *B43K 5/189* (2013.01); *A45D 2200/056* (2013.01)

(56) References Cited

U.S. PATENT DOCUMENTS

| | | | | |
|---|---|---|---|---|
| 6,200,055 | B1 | 3/2001 | Fusaro, Jr. | |
| 10,391,516 | B2 | 8/2019 | Sumiyoshi | |
| 2011/0250007 | A1 | 10/2011 | Kang | |
| 2011/0253493 | A1 | 10/2011 | Svara | |
| 2013/0279965 | A1 | 10/2013 | Tani | |
| 2016/0360855 | A1* | 12/2016 | Byun | A45D 34/04 |
| 2017/0297050 | A1 | 10/2017 | Sumiyoshi | |
| 2018/0035781 | A1* | 2/2018 | Byun | B65D 83/386 |
| 2018/0116369 | A1* | 5/2018 | Byun | B05B 11/1052 |
| 2019/0029393 | A1* | 1/2019 | Chung | G01F 11/025 |
| 2019/0314840 | A1* | 10/2019 | Brugger | B05B 11/0032 |

FOREIGN PATENT DOCUMENTS

| | | | |
|---|---|---|---|
| DE | 19742559 | A1 | 8/1999 |
| DE | 10327589 | B4 | 3/2017 |
| DE | 102018003323 | A1 | 10/2019 |
| EP | 0357455 | A2 | 3/1990 |
| EP | 3231323 | A1 | 10/2017 |
| GB | 1470350 | A | 6/1974 |
| JP | 2017189416 | A | 10/2017 |
| WO | 2012026627 | A1 | 3/2012 |

OTHER PUBLICATIONS

European Patent Office, Written Opinion of the International Searching Authority for International Application No. PCT/EP2020/065281, dated Jul. 7, 2020.

* cited by examiner

DEVICE FOR APPLYING A VISCOUS SUBSTANCE

The invention relates to a device for applying a viscous substance, in particular for cosmetic, writing, painting, drawing and/or marking purposes, having a tank for the substance, an applicator and a conveyor designed to convey the substance from the tank to the applicator.

Devices of the type mentioned above are known, for example, from DE 103 27 589 B4. A container with a pump is also known from DE 197 42 559 C2. With the known devices, the conveyor consists of a plurality of individual parts, which requires a high degree of installation work. In addition, the known devices use materials that are critical in connection with cosmetic substances, for example. Examples are return springs made of steel and valve bodies made of steel.

The invention is based on the object of developing the device of the type mentioned above in such a way that the number of parts is reduced. Furthermore, with regard to the substances to be applied, critical materials are to be avoided.

According to the invention, the object is solved by the conveyor having a cylinder, a first and a second closing device, both of which are arranged in an axially displaceable manner in the cylinder, a pump tappet for axially displacing the closing devices, a first connecting channel between the cylinder and the tank and a second connecting channel between the cylinder and the applicator, the first closing device opening or closing the first connecting channel depending on its position relative to the cylinder and the second closing device being adjustable relative to the pump tappet, opening or closing the second connecting channel depending on its position relative to the pump tappet and, together with the cylinder, forming a pump in which it serves as a piston or represents the piston.

According to the invention, it is provided, in accordance with the above statements, that the pump tappet has a dual function, namely on the one hand the axial displacement of the two closing devices and on the other hand the opening or closing of the second connecting channel by changing its position relative to the second closing device. Firstly, this reduces the number of components required. By way of example, no (additional) valve has to be provided. Since, for example, a sphere as a valve body, which is usually made of steel, is thus also saved, critical substances are also avoided in connection with the substances to be applied. The second closing device also has a double function: closing and forming part of a pump.

The mode of operation of the application device designed according to the invention is, for example, such that by suitable movement of the two closing devices under control by means of the pump tappet, the substance to be applied is conveyed from the tank into the cylinder and from there to the applicator.

An application device comparable to the present invention is known from the German patent application 10 2018 003 323, which was filed on 24 Apr. 2018. In comparison, the applicator according to the present invention achieves a finer response behaviour due to shorter idle strokes in the respective stroke movements. Furthermore, there are fewer frictional influences due to the omission of one of the two connection openings in the outer surface of the pump tappet. A possibly provided pump cage can be integrated into the tank, whereby simpler and cheaper injection moulding tools can be used. Finally, safe leakage protection is achieved. It is even possible to work with stable ink.

According to the invention, it is preferably provided that the second closing device rests against a first stop of the pump tappet in the pressure stroke with respect to the cylinder and against a second stop of the pump tappet in the suction stroke with respect to the cylinder.

In other words, two stops are provided, by means of which the movement of the second closing device can be controlled by means of the pump tappet.

According to the invention, it is further preferably provided that the second closing device is adjustable between a first and second stop on the pump tappet and opens the second connecting channel when it abuts the first stop and closes the second connecting channel when it abuts the second stop. The two stops are preferably identical to the two stops against which the second closing device abuts in the pressure stroke or in the suction stroke. In this way, it can be achieved that the second connecting channel is automatically opened by the second closing device with respect to the cylinder in the pressure stroke and automatically closed in the suction stroke. In this way, a suction stroke followed by a pressure stroke can be used to convey substance from the cylinder to the applicator.

According to a further preferred embodiment of the invention, it is provided that the first closing device closes the first connecting channel in the pressure stroke relative to the cylinder and opens the first connecting channel at least in a partial section of the suction stroke relative to the cylinder.

In turn, this automatic closing or opening of the first connection channel ensures that substance is conveyed from the tank into the cylinder by means of a suction stroke.

According to the invention, successive pressure and suction strokes thus preferably cause the substance to be applied to be conveyed first from the tank into the cylinder and then further from the cylinder to the application element, wherein the opening and closing of the first and second connecting channel required for this purpose in each case takes place automatically, and in each case only by appropriate use of the two closing devices.

According to the invention, it is further preferably provided that the second connecting channel lies at least in sections in the pump tappet. This makes the conveyor and thus the entire application device particularly compact.

Further preferably, the second closing device surrounds the pump tappet in a ring-like or sleeve-like manner. It can thus be designed as an O-ring according to a particularly preferable embodiment of the invention. These designs serve in turn to achieve greater compactness.

According to the invention, the cylinder can preferably be formed in one piece with the tank. In this way, the number of parts is reduced.

Further preferably, it can be provided that the first closing device is designed in one piece with the pump tappet. This again serves to reduce the number of parts. However, the first closing device cannot be designed in one piece with the pump tappet as well. Their separate production causes hardly any problems and increases cost only insubstantially.

The movement of the pump tappet to control the two closing devices can, in accordance with the invention, be carried out in any way. However, it is preferably provided that the applicator has two parts which can be rotated against each other and a transmission that converts a rotation of the two parts against each other into an axial movement of the pump tappet. The two parts that can be rotated against each other can, for example, be two parts of the device shaft. In this design, it is sufficient to rotate the named parts in relation to each other in order to generate a pressure stroke or a suction stroke.

According to the invention, the transmission also preferably has a cam guided by means of a guide curve, wherein the guide curve runs along a closed path. With this design, for example, a suction stroke is also generated after a pressure stroke when the two parts that can be rotated against each other are always rotated in the same direction against each other. This is because, due to the closed path described by the guide curve, the cam over the pump tappet will always move the two closing devices back and forth, regardless of the direction in which the two rotatable parts are rotated against each other.

All parts can be made of plastic, in particular of ABS or PP.

Figure 2A:
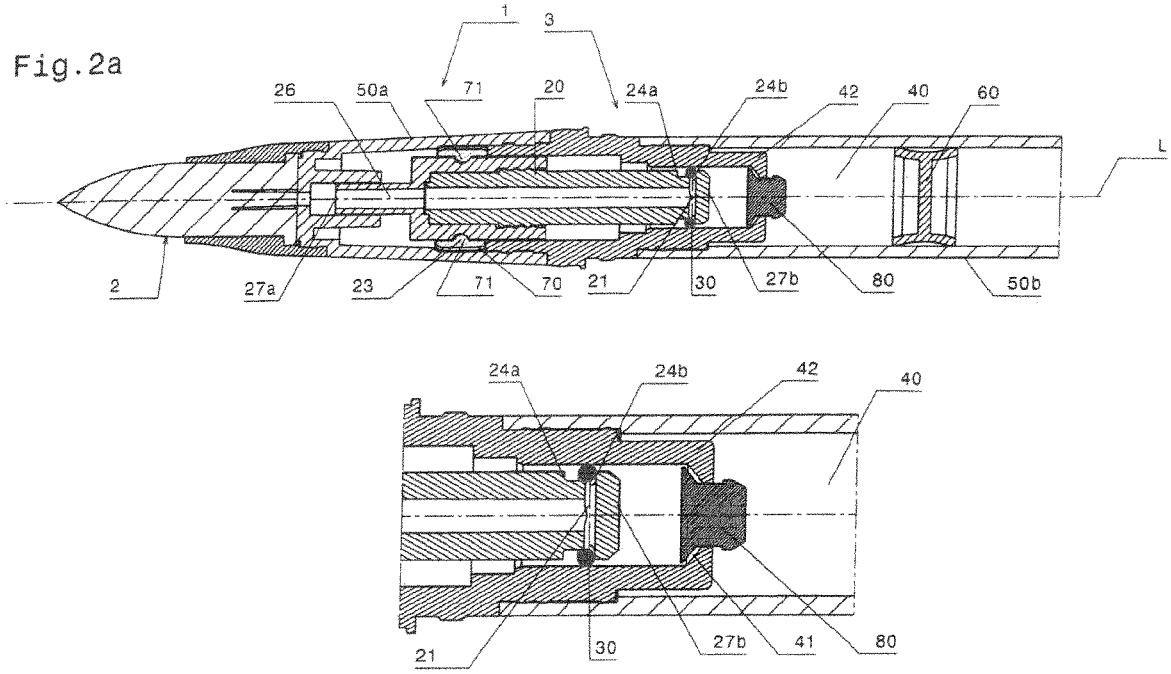
Figure 2B:
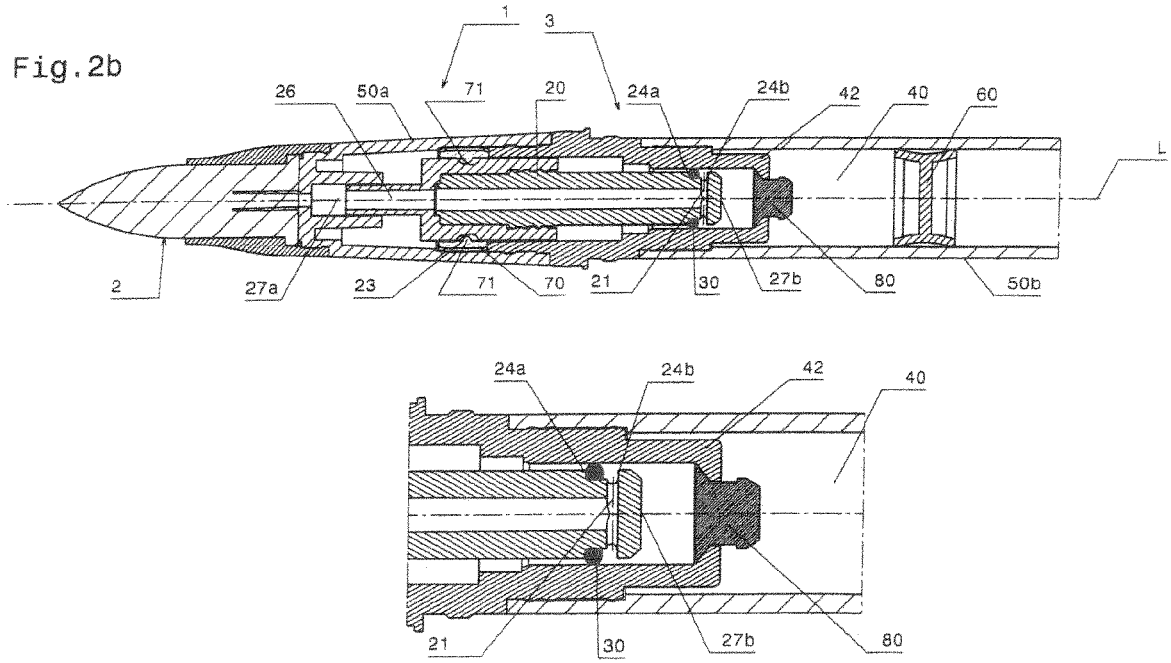
Figure 2C:
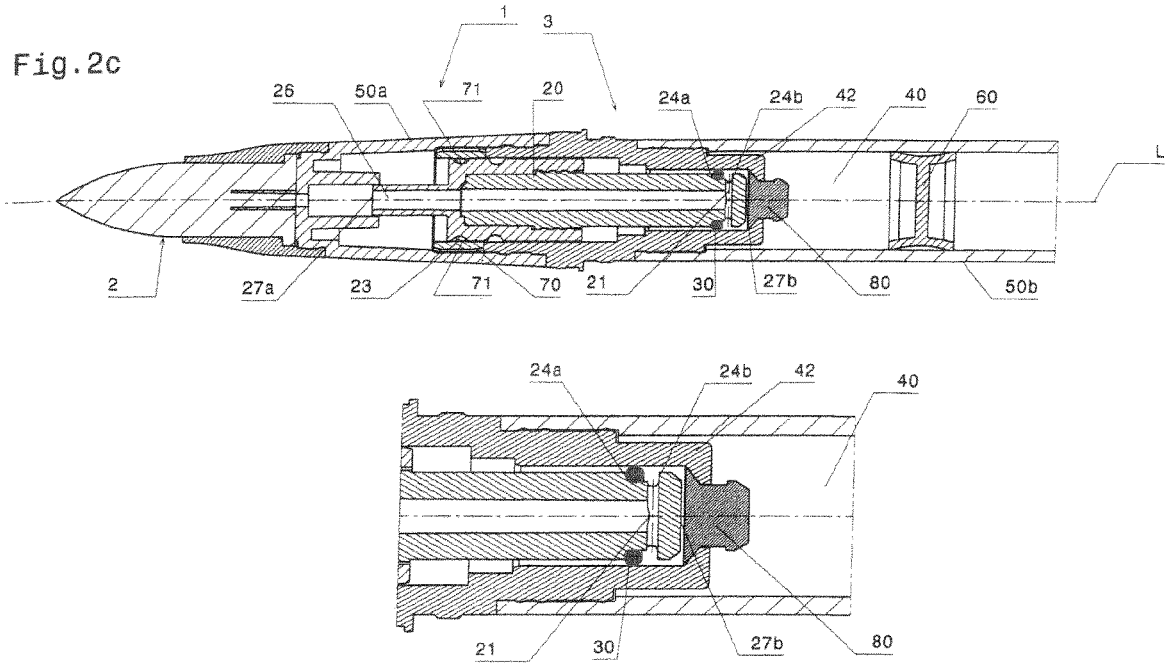
Figure 2D:
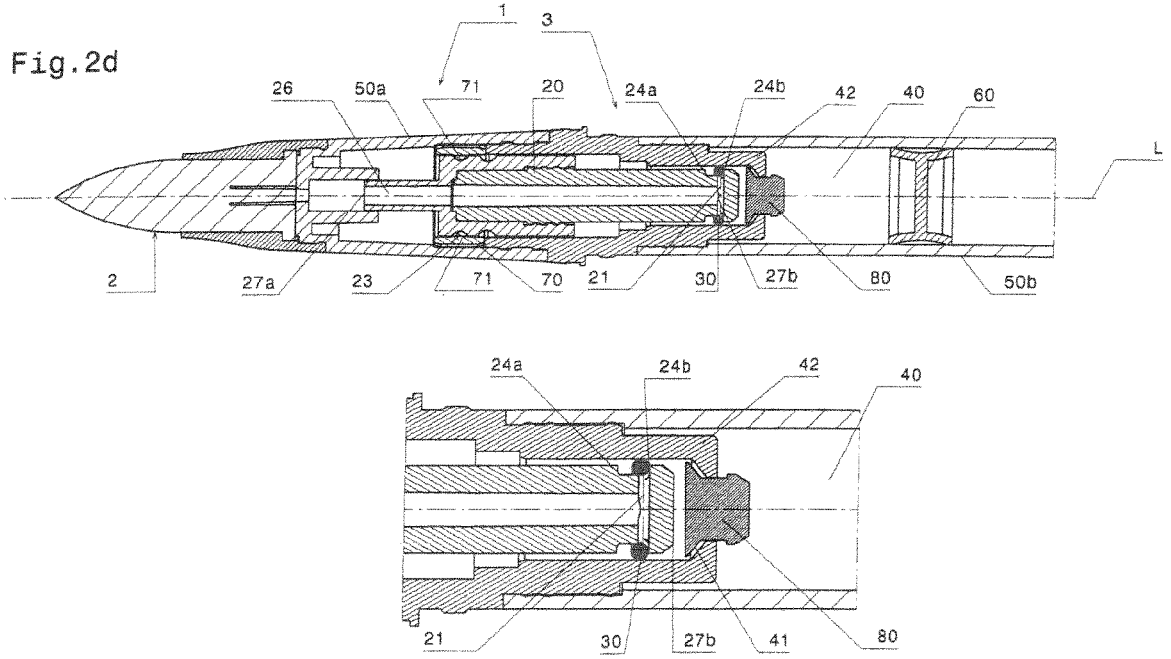
Figure 2E:
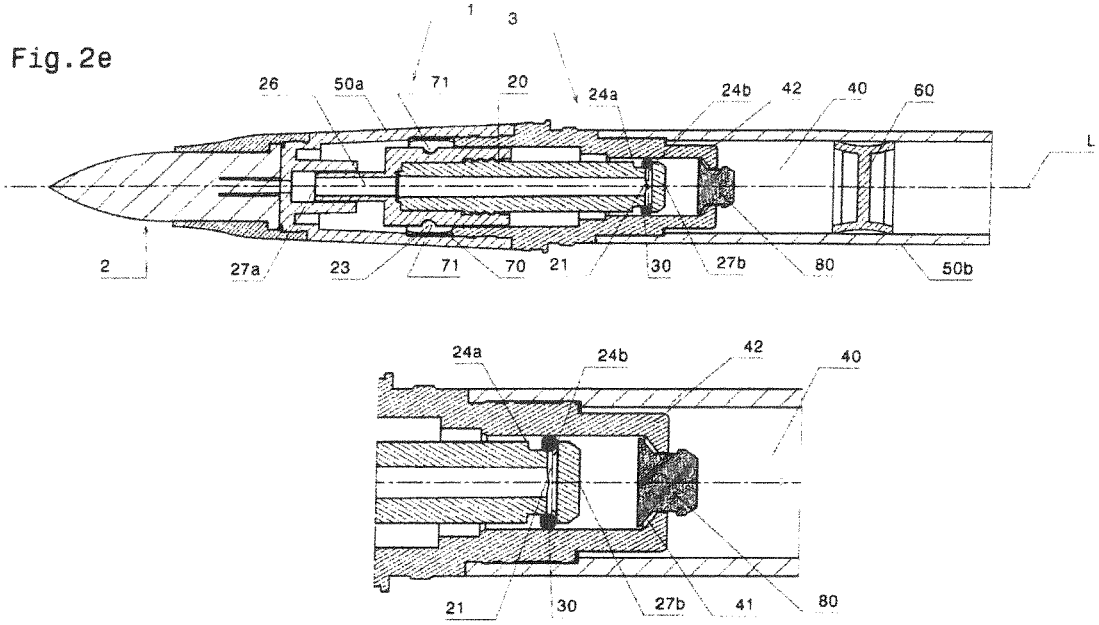
Figure 3:
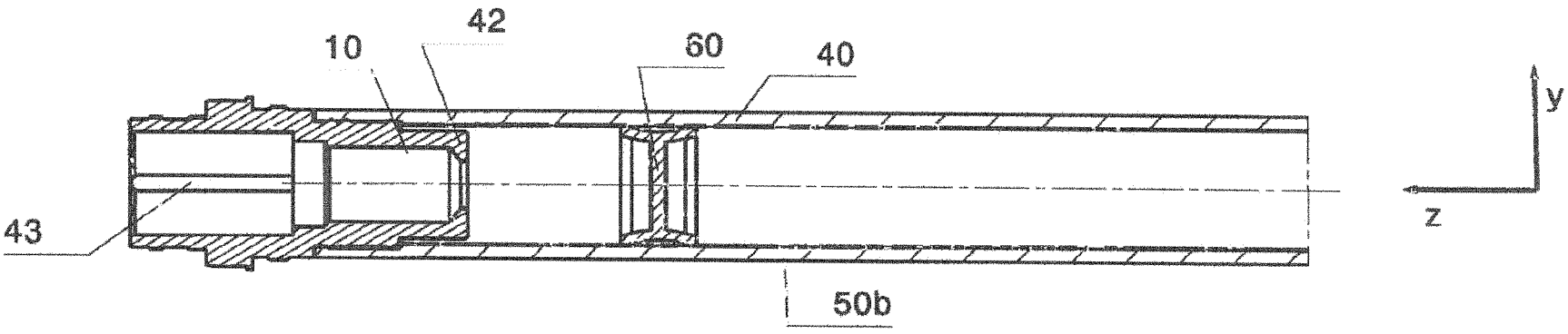
Figure 4A:
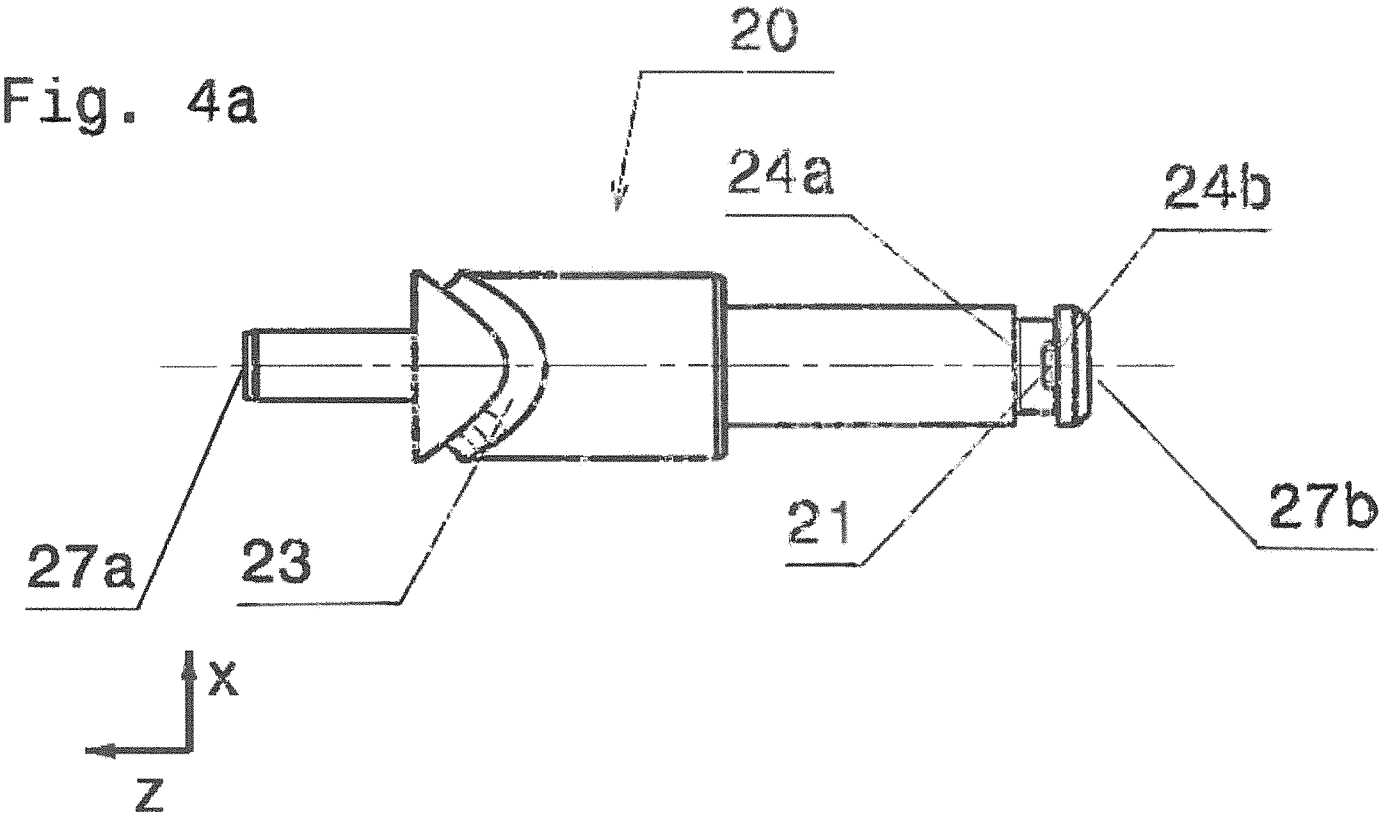
Figure 4B:
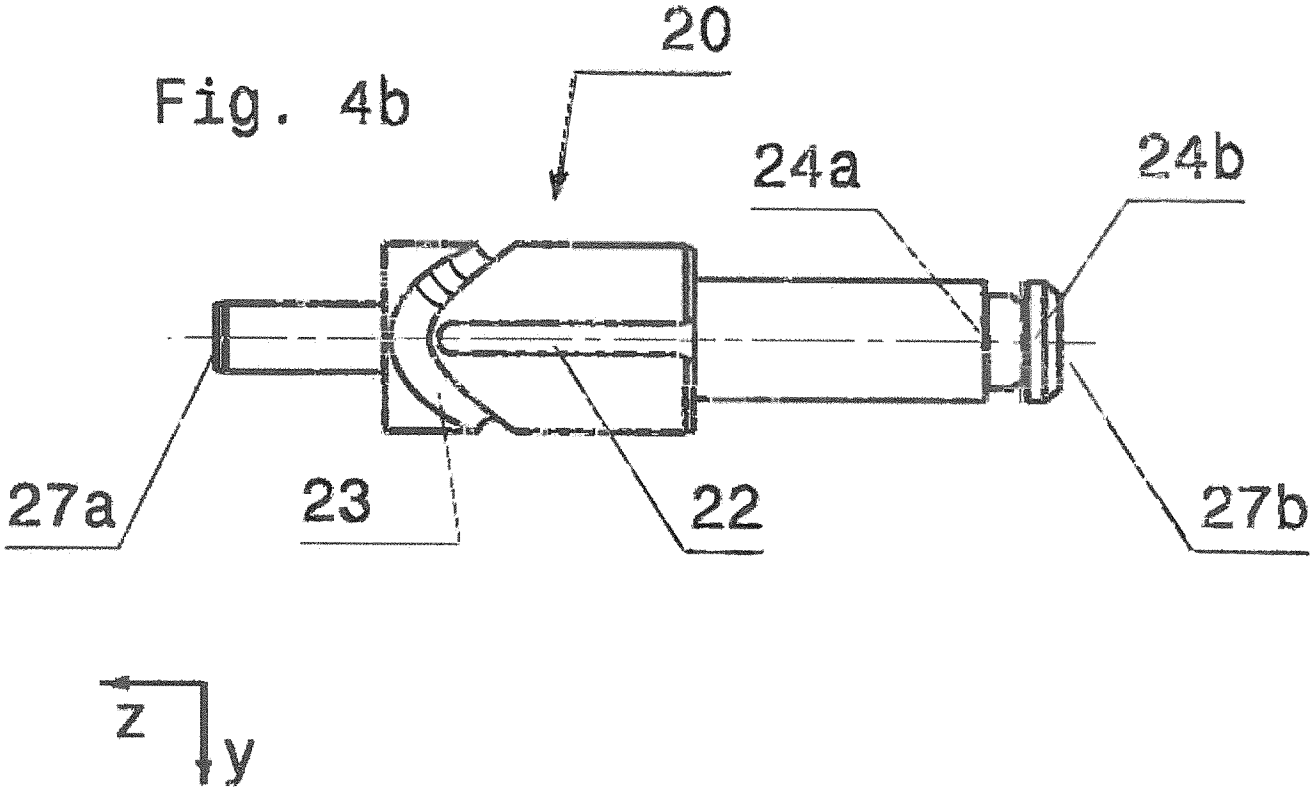
Figure 5:
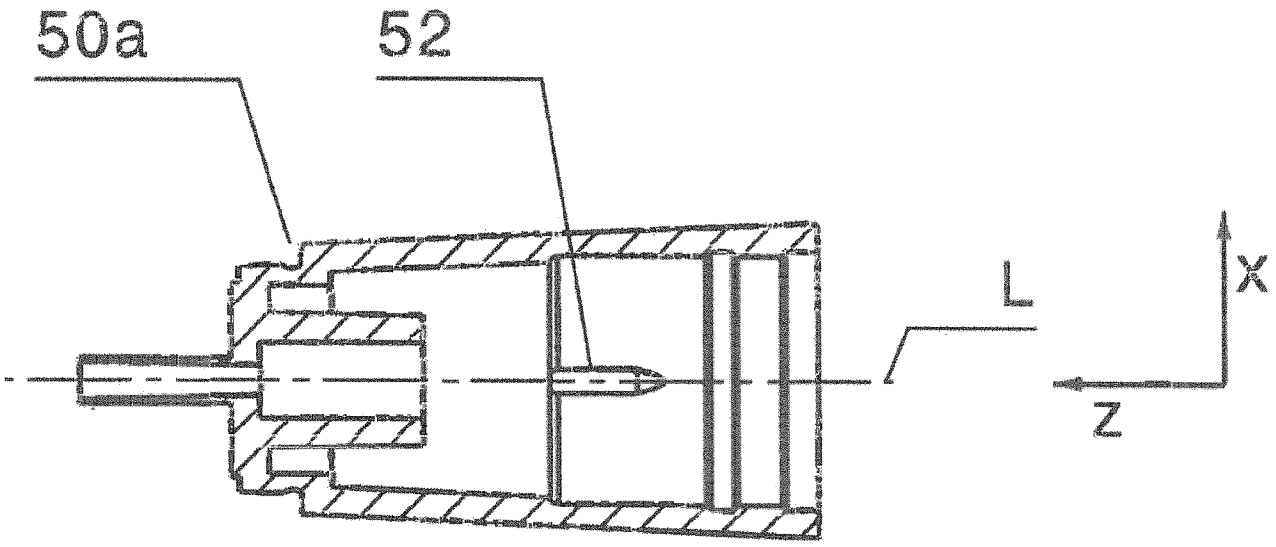
Figure 6A:
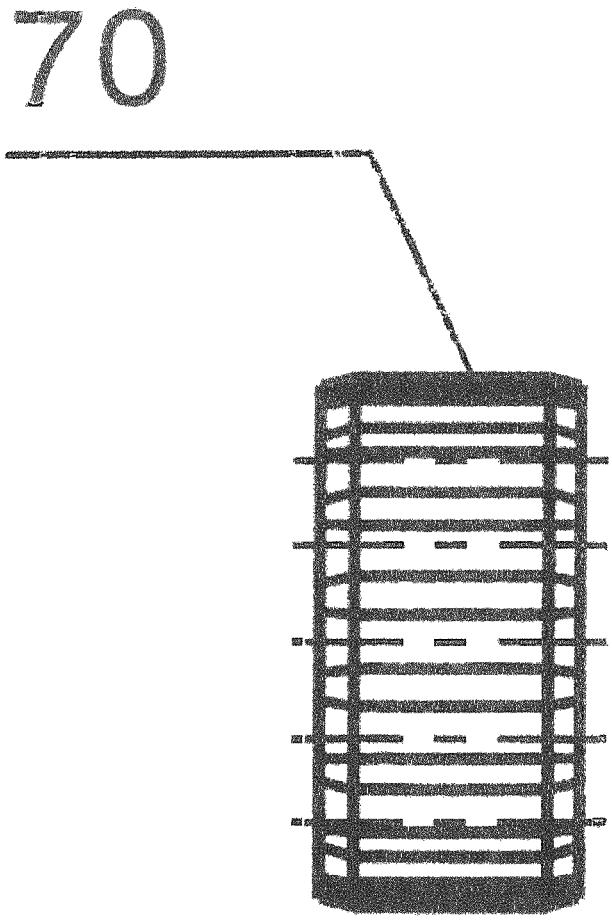
Figure 6B:
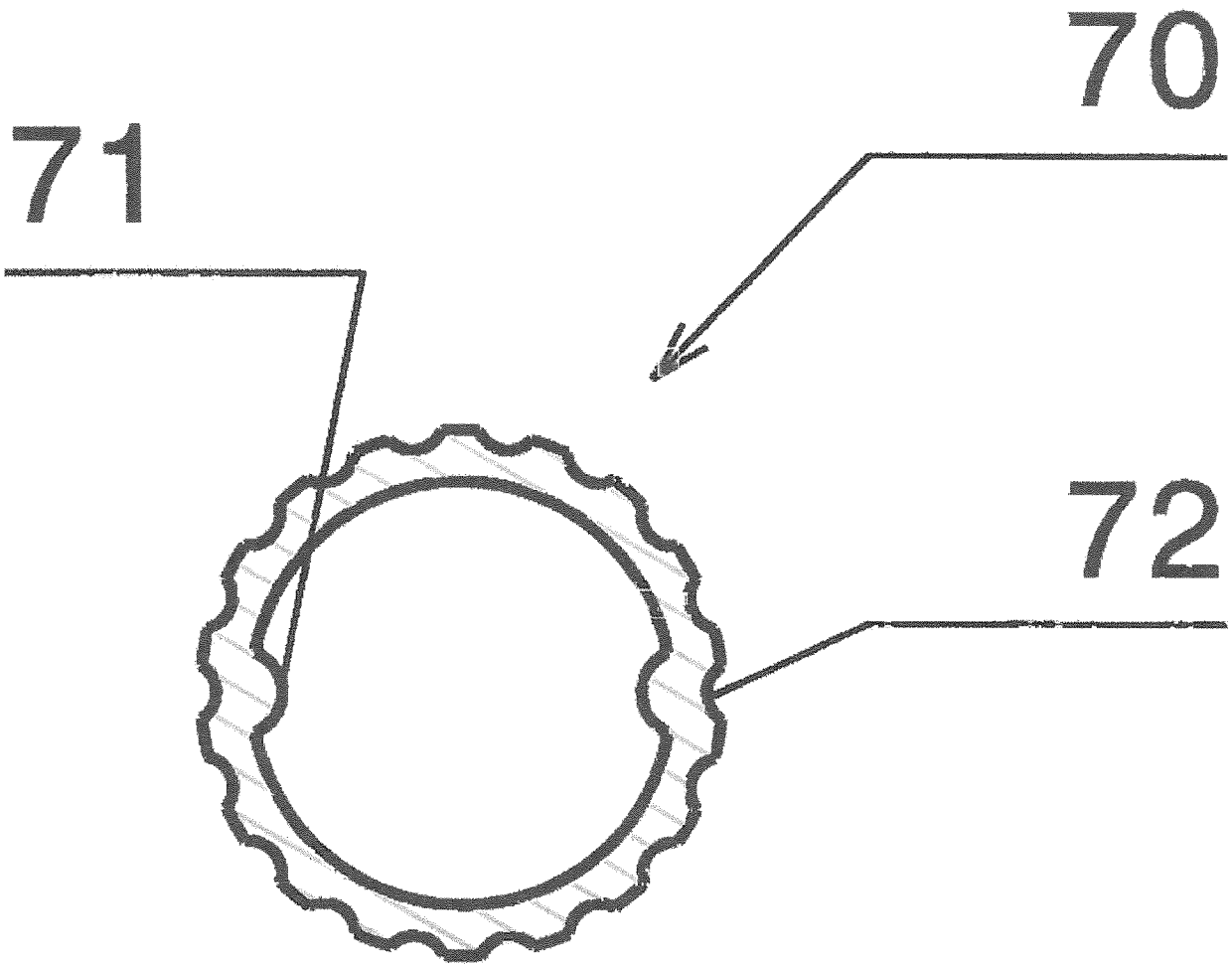
Figure 7:
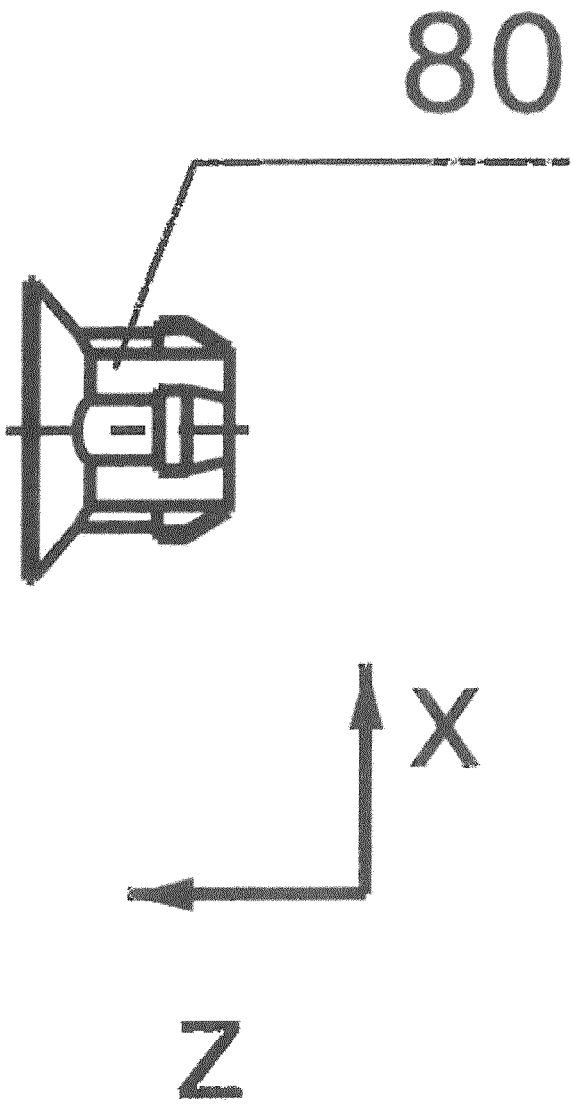
Figure 8:
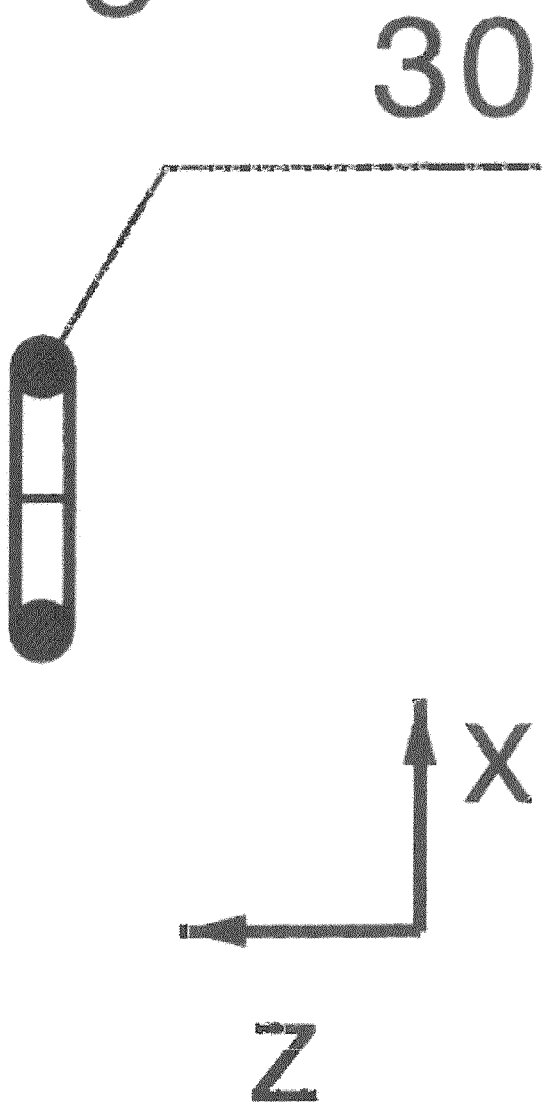
Figure 9:
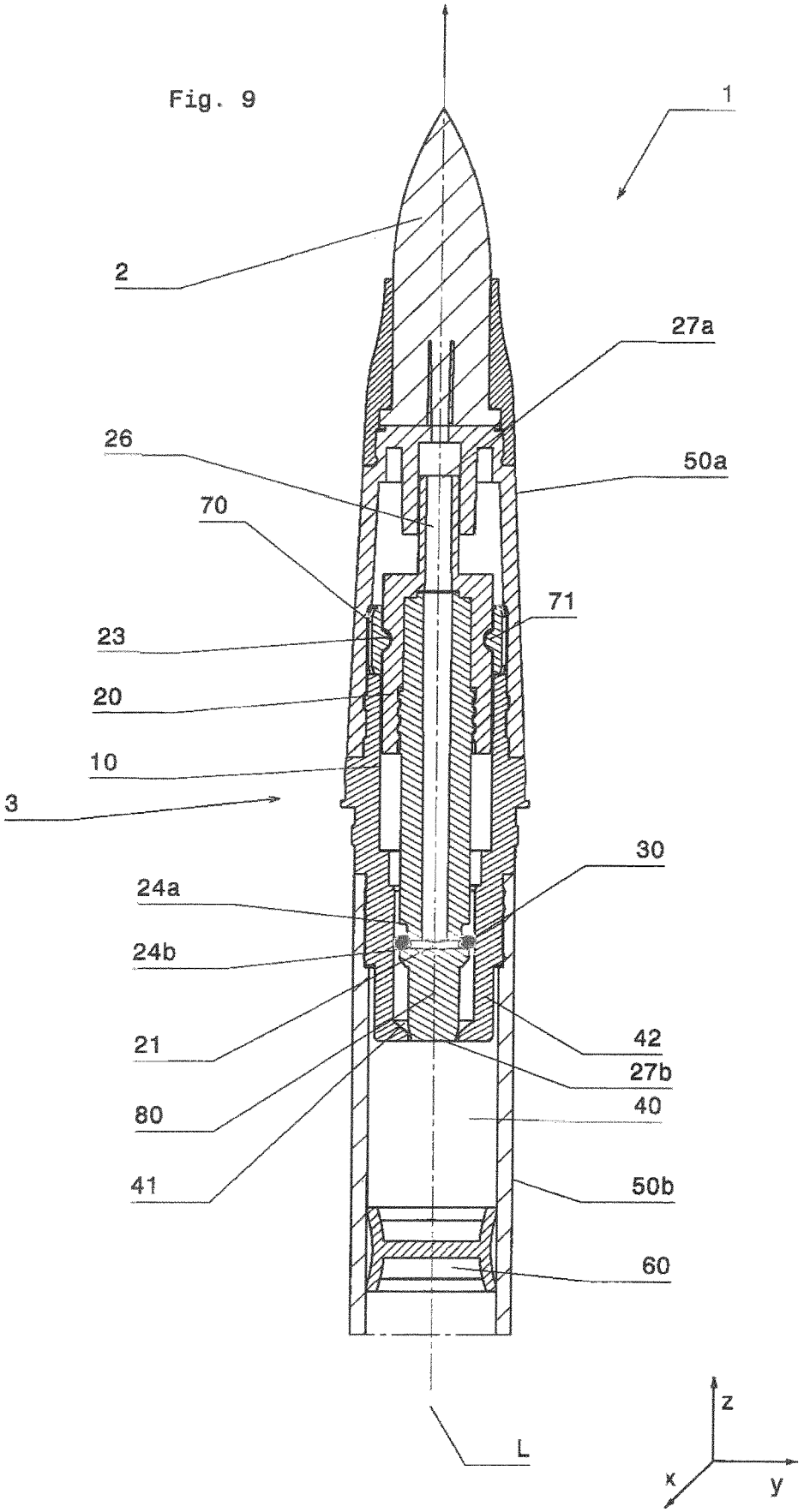
Figure 10A:
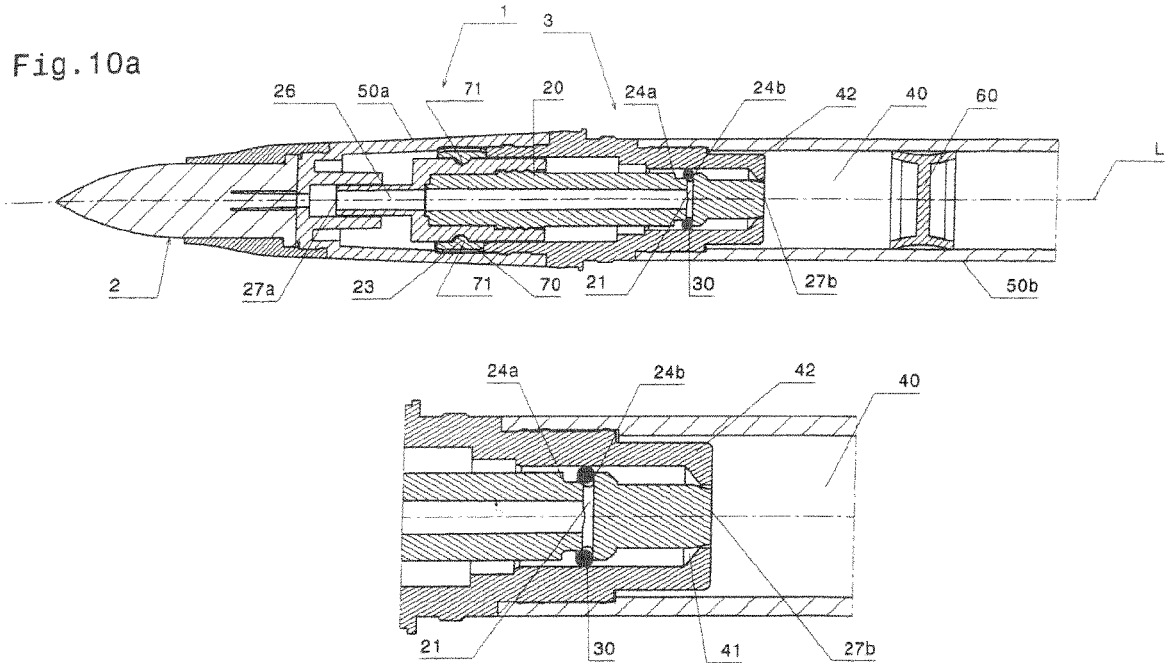
Figure 10B:
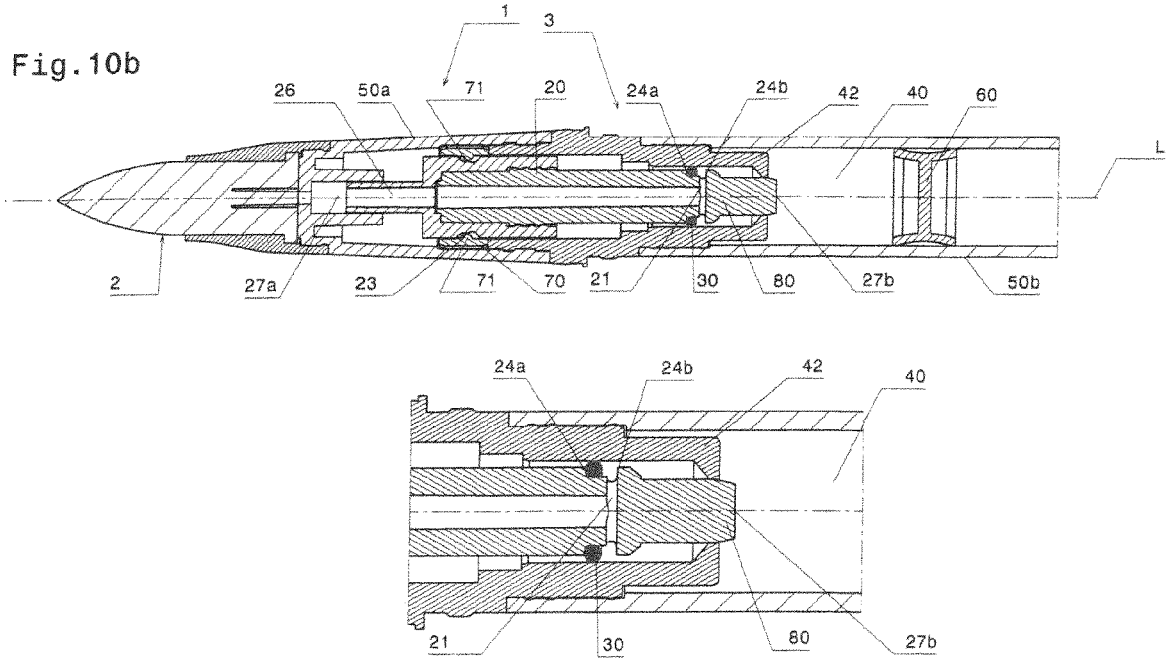
Figure 10C:
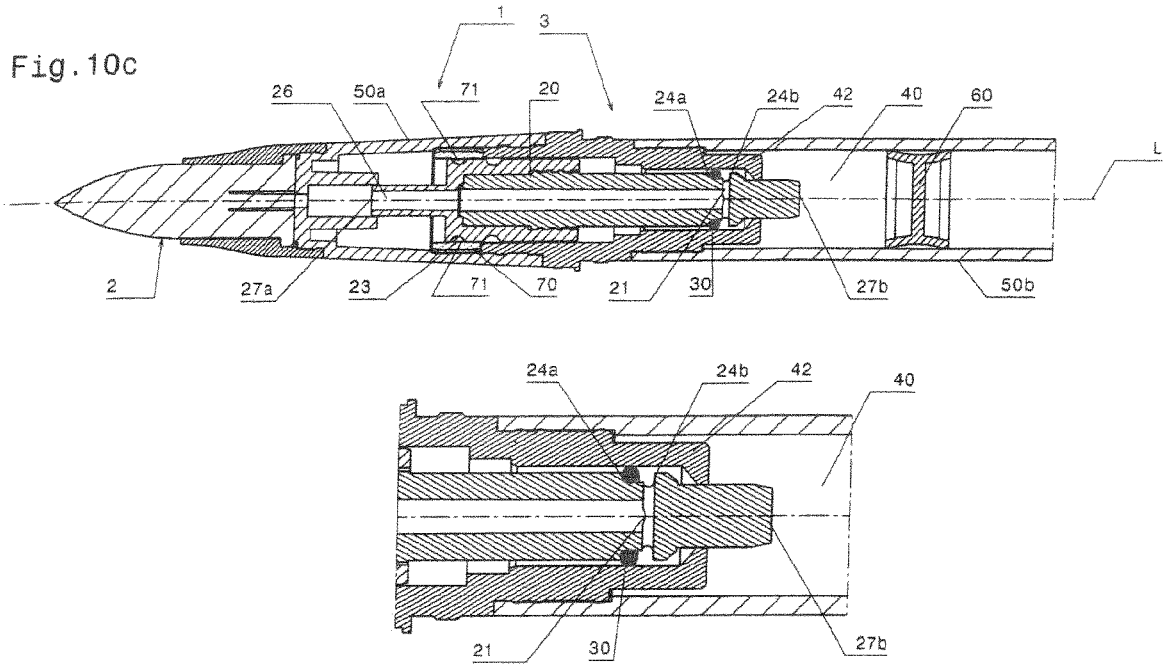
Figure 10D:
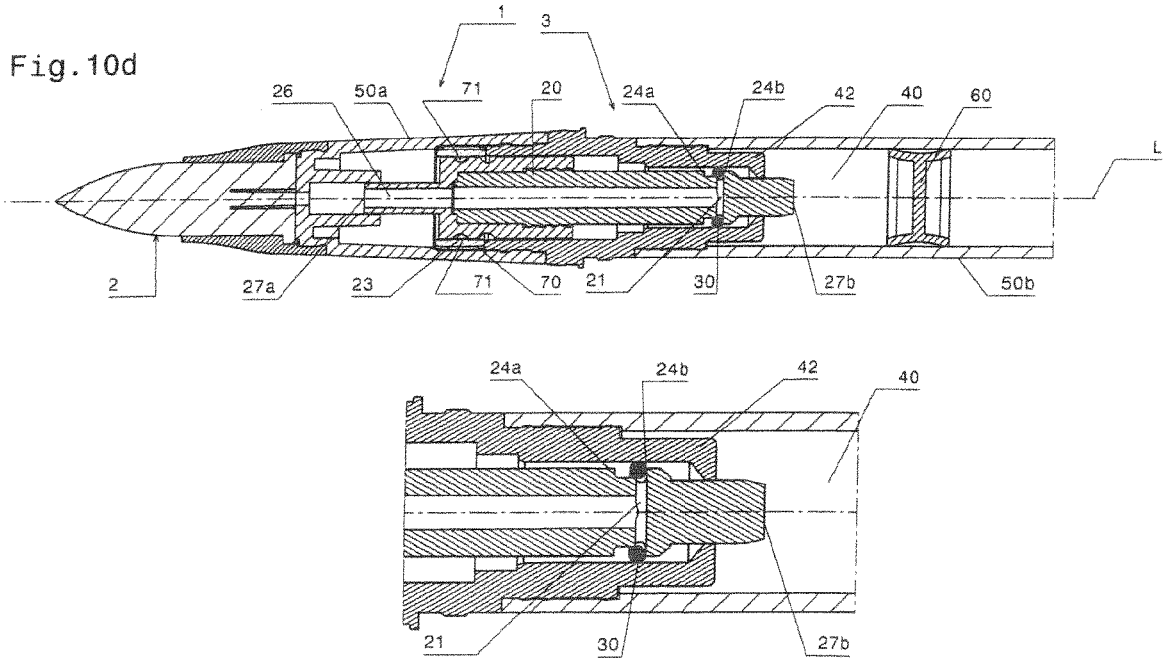
Figure 10E:
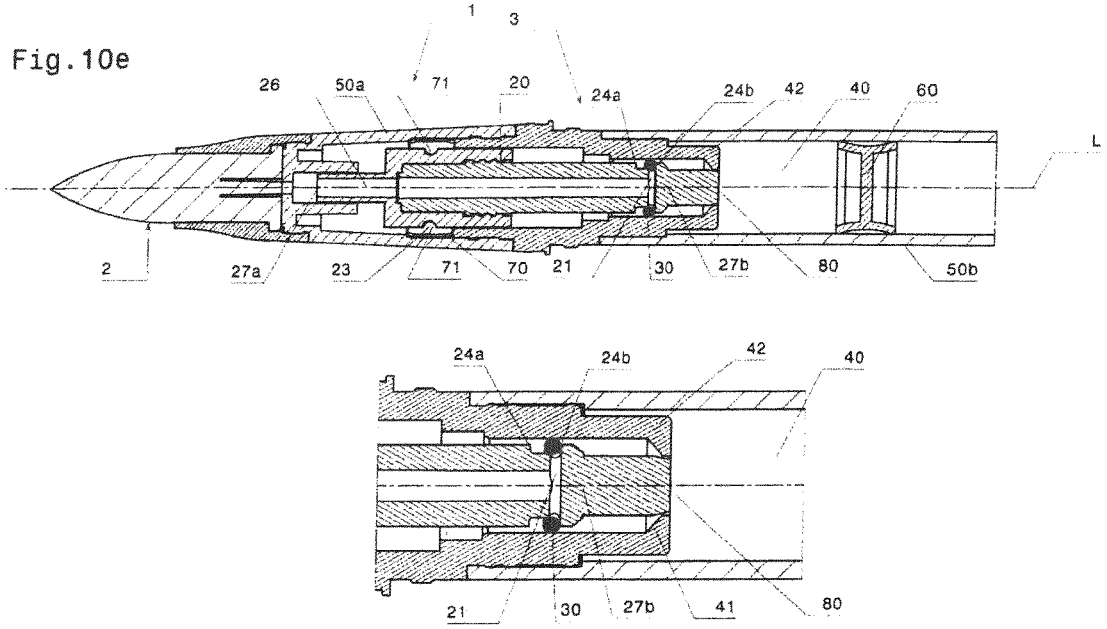
Figure 11A:
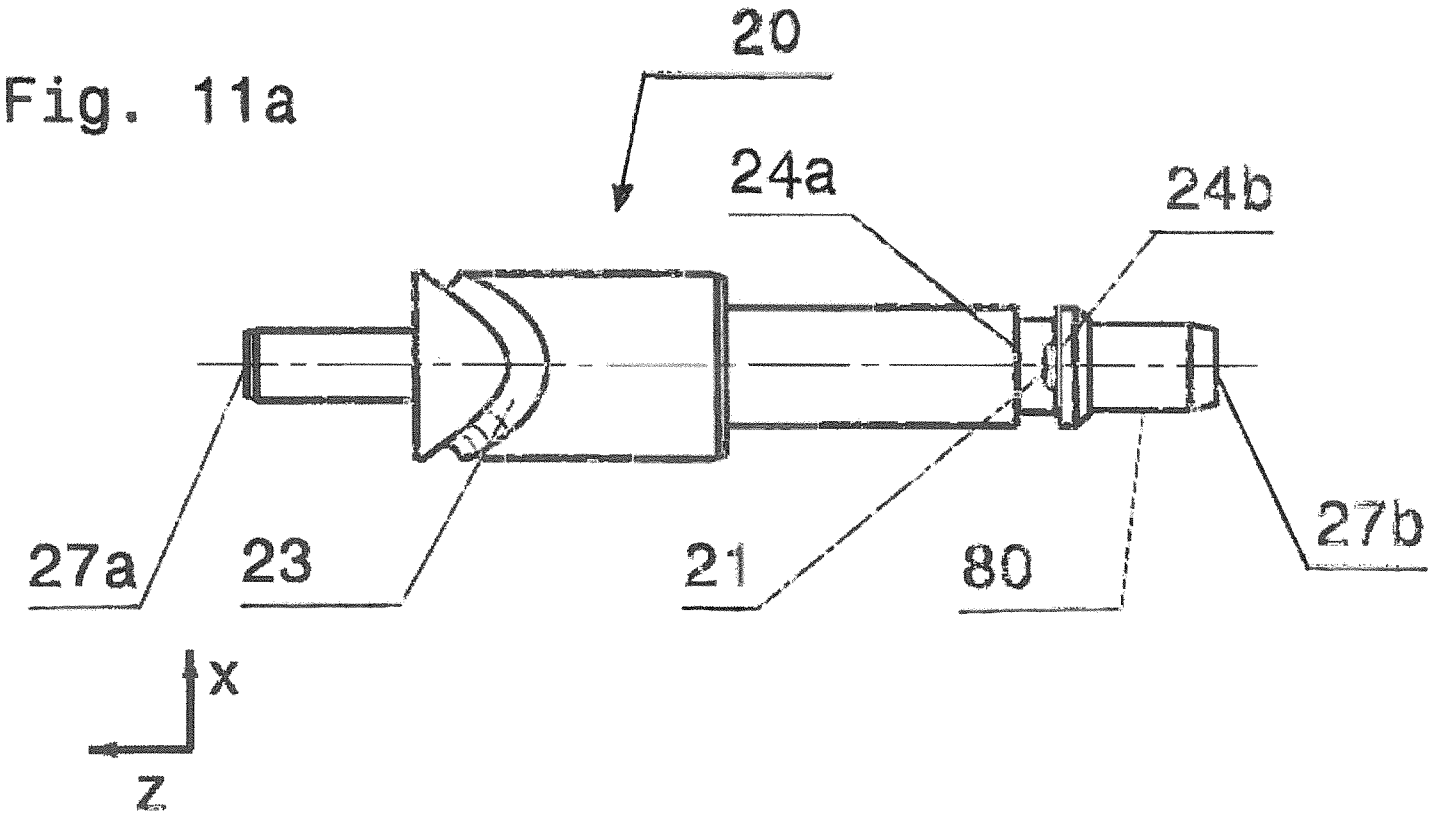
Figure 11B:
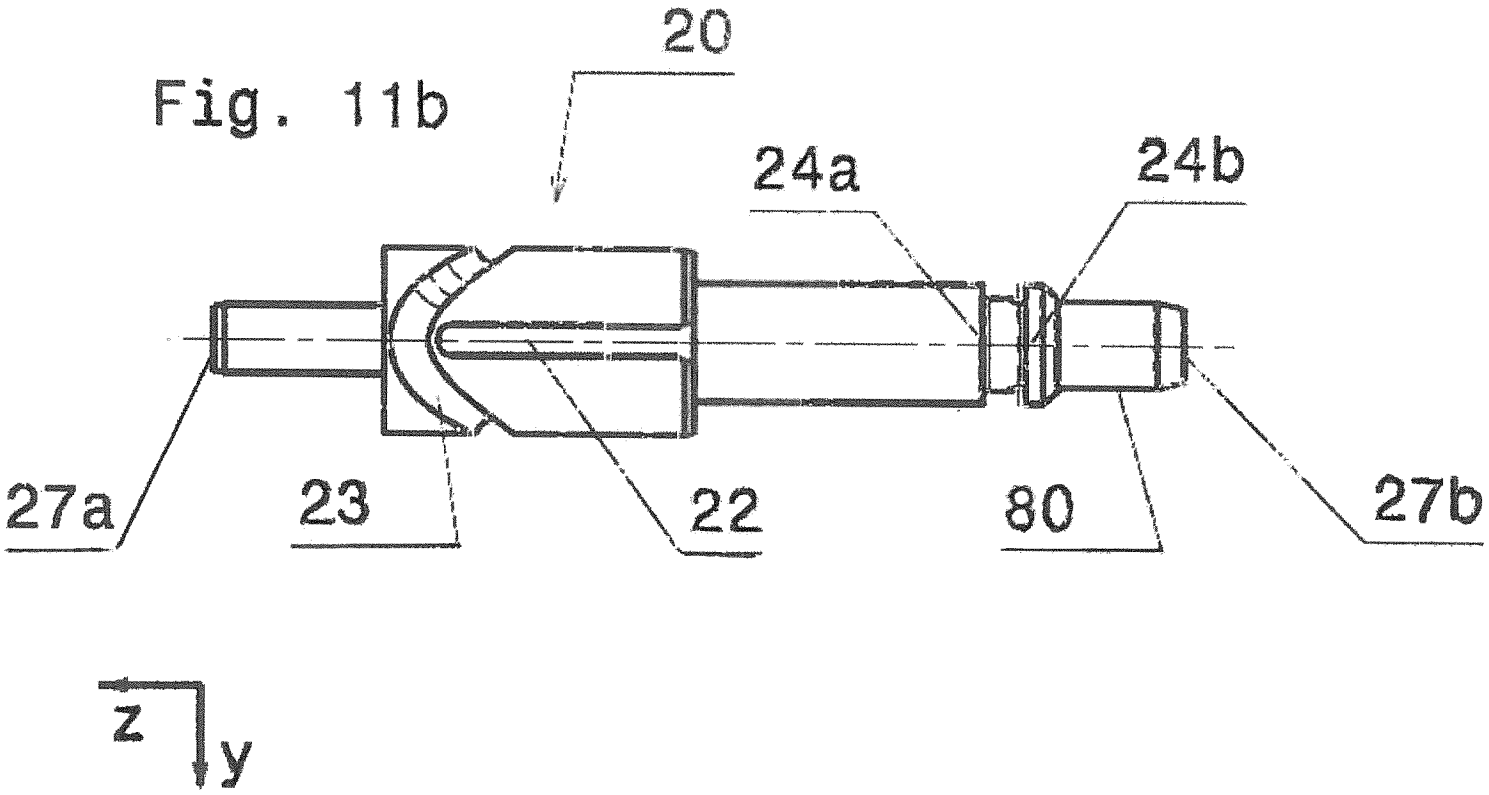

In the following, the invention is explained in more detail by means of preferred exemplary embodiments with reference to the appended drawing. Here are shown:

FIG. 1 a longitudinal sectional view of a first exemplary embodiment of the applicator according to the invention, FIG. 2*a* on the one hand, the same view as FIG. 1, but on a smaller scale, and on the other hand an enlarged partial view thereof, FIGS. 2*b* to 2*e* the same views as FIG. 2*a*, but in different operating conditions FIG. 3 a cylinder, a tank and a drag piston of the applicator according to FIG. 1, FIGS. 4*a* and 4*b* a pump tappet of the applicator according to FIG. 1 in different rotational positions, FIG. 5 a first rotatable part of the applicator according to FIG. 1 in the form of a cartridge, FIGS. 6*a* and 6*b* views of a drive ring of the applicator according to FIG. 1, FIG. 7 a first closing device of the applicator according to FIG. 1 in the form of a plug, FIG. 8 a second closing device of the applicator according to FIG. 1 in the form of an O-ring, FIG. 9 the same view as FIG. 1, but from a different exemplary embodiment, FIGS. 10*a* to 10*e* the same views as FIGS. 2*a* to 2*e*, but from the second exemplary embodiment and FIGS. 11*a* to 11*b* the same views as FIGS. 4*a* and 4*b*, but again from the second exemplary embodiment.

FIG. 1 shows a sectional view of a first embodiment of the device 1 according to the invention for applying a viscous substance (hereinafter referred to as application device 1). The application device 1 extends along a longitudinal axis L which is parallel to a Z-axis direction.

The X-axis direction and the Y-axis direction are defined in such a way that FIG. 1 is a sectional view in the Y-Z plane. The application device 1 has an applicator 2 for applying the viscous substance, for example for cosmetic, writing, painting, drawing and/or marking purposes. Furthermore, the application device 1 has a cartridge 50*a* connected to the applicator 2 and a shaft 50*b* connected to the cartridge 50*a*. The cartridge 50*a* and the shaft 50*b* can be rotated against each other around the longitudinal axis L. For this reason, the cartridge 50*a* is also referred to as the first rotatable part and the shaft 50*b* as the second rotatable part.

The shaft 50*b* has a hollow interior designed as a tank 40 to receive the viscous substance, A pump cage 42 is formed in the tank 40, said pump cage being connected to the tank 40 via a first connecting channel 41 (FIG. 2*a*), wherein the first connecting channel 41 is also referred to as the first dosing opening. Through the first connecting channel 41, the viscous substance can pass from the tank 40 into the pump cage 42. A drag piston 60 is arranged in the tank 40, which moves towards the applicator 2 when the viscous substance is discharged from the tank 40. In this way, a constant pressure is maintained in the tank 40. Instead of the drag piston 60, a closing mass can also be used.

A conveyor 3 serves to convey the viscous substance from the tank 40 via the pump cage 42 to the applicator 2. For this purpose, the conveyor 3 has a cylinder 10, which in the exemplary embodiment shown in FIG. 1 is formed in one piece with the pump cage 42. Furthermore, the conveyor 3 has an O-ring 30 arranged in an axially displaceable manner in the cylinder 10 and a pump tappet 20 for the axial displacement of the O-ring 30. The O-ring 30 is pushed onto the pump tappet 20. The pump tappet 20 has a front end 27*a* connected to the applicator 2 and a rear end 27*b* extending into the pump cage 42. A tappet bore 26 extends from the front end 27*a* of the pump tappet 20 to its rear end 27*b* through the pump tappet 20. At the rear end 27*b* of the pump tappet 20, a second connecting channel 21 is formed, which represents a connection between the pump cage 42 and the tappet bore 26 and which is also referred to as the second dosing opening.

By rotating the cartridge 50*a* with respect to the shaft 50*b* around the longitudinal axis L, the pump tappet 20 is moved in the cylinder 10 along the longitudinal axis L (Z-axis). For this purpose, the application device 1 is designed with a transmission 23, 70. The transmission 23, 70 has two cams 71 and a link 23. The cams 71 are in engagement with the link 23 formed in the pump tappet 20. As can be seen in FIGS. 4*a* and 4*b*, the link 23 is designed as a sinusoidal channel. However, it is not restricted to this shape. If the two rotatable parts, i.e. the cartridge 50*a* and the shaft 50*b*, are rotated against each other, the engagement of the cams 71 into the link 23 results in the rotational movement being converted into an axial movement of the pump tappet 20 along the longitudinal axis L. As can be further seen in FIGS. 4*a* and 4*b*, the link 23 runs along a closed path. If the cartridge 50*a* and the shaft 50*b* are rotated against each other, the cams 71 will move the pump tappet 20 up and down again and again regardless of the direction of rotation due to the closed path of the link 23. A first anti-rotation device 43 on the tank 40 and a second anti-rotation device 22 on the pump tappet 20 serve to rotationally couple the pump tappet 20 to the tank 40. In the same way, a third anti-rotation device 72 on the drive ring 70 and a fourth anti-rotation device 52 on the cartridge 50*a* serve to rotationally couple the drive ring 70 to the cartridge 50*a*.

If the pump tappet 20 is moved downwards from the position shown in FIG. 1 by rotating the cartridge 50*a* and the shaft 50*b* against each other, a first stop 24*a* will abut the O-ring 30. The O-ring 30 is therefore pressed downwards. If the pump tappet 20 is then moved upwards, a second stop 24*b* of the pump tappet 20 comes into contact with the O-ring 30. The piston 30 is then moved upwards by the pump tappet 20. Therefore, when the cartridge 50*a* and the shaft 50*b* are rotated against each other, the O-ring 30 is moved upwards and downwards again and again not only with respect to the cylinder 10, but also with respect to the pump tappet 20, regardless of the direction in which the cartridge 50*a* and the shaft 50*b* are rotated against each other.

FIGS. 4*a* and 4*b* show the pump tappet 20 of the conveyor 3 according to the invention having the sinusoidal link 23, The pump tappet 20 shown in FIG. 4*a* is rotated by 90° around the longitudinal axis L (Z axis) in FIG. 4*b*. At the rear end 27*b* of the pump tappet 20, the second connecting channel 21 can be seen in FIG. 4*a*. Furthermore, the second anti-rotation device 22 can be seen in FIG. 4*b*, which engages with the first anti-rotation device 43.

In the following, the functionality of the application device 1 in the embodiment according to FIG. 1 with reference to FIGS. 2*a* to 2*e* is described by way of example:

FIG. 2*a*, like FIG. 1, shows the application device 1 in the starting position. In this position, the pump tappet 20 and the O-ring 30 are arranged in the cylinder 10 in such a way that the O-ring 30 closes the second connecting channel 21 of the pump tappet 20. The tank 40 and the pump cage 42 are connected to each other via the first connecting channel 41. The pump cage 42 is filled with the viscous substance in this starting position.

Now the cartridge 50*a* and the shaft 50*b* are rotated against each other around the longitudinal axis L. Thus, the rotation can occur in any direction. Due to the interaction of the link 23 and the cams 71, the pump tappet 20 is displayed along the longitudinal axis L in the direction of the tank 40 as explained above. The rotation of the cartridge 50*a* is thus translated into a movement of the pump tappet 20 along the longitudinal axis L via the cams 71, which run in the link 23 of the pump tappet 20, and via the second anti-rotation device 22 of the pump tappet 20, which is guided in the first anti-rotation device 43 of the shaft 50*b*. Due to the axial movement of the pump tappet 20, the first stop 24 of the pump tappet 20 comes into contact with the O-ring 30. The O-ring 30 is then moved together with the pump tappet 20 in the direction of the tank 40.

FIG. 2*b* shows a condition in which the pump tappet 20 has been moved in the direction of the tank 40. Due to the movement of the pump tappet 20 and the filling of the pump cage 42 with the viscous substance, the plug 80 has also been moved in the direction of the tank 40 and now closes the first connecting channel 41 between the tank 40 and the pump cage 42, which was still open in the position according to FIG. 2*a*. Since as already mentioned pressure is exerted on the viscous substance in the pump cage 42 by the movement of the pump tappet 20 in the pump cage 42, this movement of the O-ring 30 in the direction of the tank 40 is also referred to as pressure stroke. This movement performed by the pump tappet 20 in the pressure stroke results in a displacement of the O-ring 30 to the left in relation to the pump tappet in FIG. 2, whereby the second connecting channel 21 is opened. In this way, the pressure built up in the pump cage 42 is reduced by conveying the viscous substance through the second connecting channel 21 via the tappet bore 26 to the applicator 2.

FIG. 2*c* shows a condition in which the pump tappet 20 has been pushed as far as possible into the pump cage 42. The maximum movement of the pump tappet 20 in the direction of the longitudinal axis L is referred to as the axial stroke and is determined by the curve shape of the link 23. Due to the design of the link 23, for example sinusoidal, as shown in FIGS. 4*a* and 4*b*, a further rotation of the cartridge 50*a* in the direction of rotation results in a change in the direction of the movement of the pump tappet 20, which now moves in the direction of the applicator 2. Due to the static friction between the O-ring 30 and the cylinder 10, the O-ring 30 is only moved in the direction of the applicator 2 when the second stop 24*b* comes into contact with the O-ring 30. As a result, the second connecting channel 21 is closed by the O-ring 30 enclosing the pump tappet 20. Thus no further viscous substance can enter the tappet bore 26 (see FIG. 2*d*).

If the cartridge 50*a* is rotated further, the condition shown in FIG. 2*e* is achieved. The movement of the O-ring 30 within the cylinder 10 towards the applicator 2 creates suction and thus a vacuum in the pump cage 42. This vacuum causes a movement of the plug 80, also in the direction of the applicator 2. This opens the first connecting channel 41 and the vacuum is balanced by sucking viscous substance from the tank 40 into the pump cage 42. This movement is therefore also referred to as suction stroke. The pump cage 42 is thus filled with fresh substance from the tank 40 for the next pump cycle. In addition, the drag piston 60 is trailed through the vacuum. If the cartridge 50*a* is now further rotated around the longitudinal axis L, the application device again reaches the operating condition according to FIG. 2*a* and the pump cycle starts again.

The second exemplary embodiment of the invention shown in FIGS. 9 to 11*b* corresponds to the first exemplary embodiment except for the fact that the plug 80 (first closing device) specified separately in the first exemplary embodiment is designed in one piece with the pump tappet 20 in the second exemplary embodiment. The number of parts is therefore reduced accordingly.

The function is, however, substantially the same, wherein in the operating condition according to FIG. 10*d*, however, the two connecting channels 41 and 21 are both closed at the same time, such that only a vacuum is built up. Only at the last moment, i.e. in the operating condition according to FIG. 10*e*, is the connection to the tank 40 opened again and the vacuum replenishes the substance. In contrast to this, in the first embodiment, the mechanism in the substance to be conveyed moves the plug 80 already in the state according to FIG. 2*d*, which is why substance is conveyed all the way from the state according to FIG. 2*d* to the state according to FIG. 2*e*.

The features of the invention disclosed in the above description, the claims and the drawing can be essential for the implementation of the invention in its various embodiments, both individually and in any combination.

What is claimed is:

1. A device for applying a viscous substance, comprising
- a tank configured to store the viscous substance;
- an applicator; and
- a conveyor configured to convey the viscous substance from the tank to the applicator,
- the conveyor including
  - a cylinder,
  - a first closing device,
  - a second closing device, the first and second closing devices axially displaceable in the cylinder,
  - a pump tappet adjustable relative to the second closing device and configured to axially displace the first and second closing devices,
  - a first connecting channel disposed between the cylinder and the tank, and
  - a second connecting channel disposed between the cylinder and the applicator,
- wherein the first closing device opens or closes the first connecting channel depending on a position relative to the cylinder, and
- wherein the second closing device opens or closes the second connecting channel depending on a position relative to the pump tappet.

2. The device according to claim 1, wherein the second closing device is configured to be axially displaceable in the cylinder by a pressure stroke and a suction stroke, wherein the second closing device is movable between a first stop and a second stop at the pump tappet, and wherein in the pressure stroke, the second closing device contacts the first stop, and in the suction stroke, the second closing device contacts the second stop.

3. The device according to claim 1, wherein the second closing device is moveable between a first stop and a second stop on the pump tappet, and wherein when the second closing device contacts the first stop, the second connecting channel is open, and when the second closing device contacts the second stop, the second connecting channel is closed.

4. The device according to claim 1, wherein the first closing device is configured to be axially displaceable in the cylinder by a pressure stroke and a suction stroke, and wherein in the pressure stroke, the first closing device closes the first connection channel, and in the suction stroke, the first closing device opens the first connection channel.

5. The device according to claim 1, wherein the second connecting channel is disposed in the pump tappet.

6. The device according to claim 1, wherein the second closing device surrounds at least a portion of the pump tappet in the form of a ring or sleeve.

7. The device according to claim 6, wherein the second closing device is configured as an O-ring charact.

8. The device according to claim 1, wherein the cylinder and the tank are integrally formed.

9. The device according to claim 1, wherein the first closing device and the pump tappet are integrally formed.

10. The device according to claim 1, wherein the first closing device and the pump tappet are separately formed.

11. The device according to claim 1, further comprising two parts rotatable relative to each other, and a transmission for converting a rotation of the two parts in relation to one another into an axial movement of the pump tappet.

12. The device according to claim 11, wherein the transmission comprises a cam guided by a guide curve running along a closed path.

13. A conveying device for a viscous substance application device having a tank and an application apparatus, the conveying device comprising:

a cylinder;

a first closing device;

a second closing device, the first and second closing devices axially displaceable in the cylinder;

a pump tappet adjustable relative to the second closing device and configured to axially displace the first and second closing devices;

a first connecting channel disposed between the cylinder and the tank; and a second connecting channel disposed between the cylinder and the applicator, wherein the first closing device opens or closes the first connecting channel depending on a position relative to the cylinder, and wherein the second closing device opens or closes the second connecting channel depending on a position relative to the pump tappet.

14. The conveying device according to claim 13, wherein the second closing device is configured to be axially displaceable in the cylinder by a pressure stroke and a suction stroke, and wherein the second closing device is movable between a first stop and a second stop at the pump tappet, and wherein in the pressure stroke, the second closing device contacts the first stop, and in the suction stroke, the second closing device contacts the second stop.

15. The conveying device according to claim 13, wherein the second closing device is moveable between a first stop and a second stop on the pump tappet, and wherein when the second closing device contacts the first stop, the second connecting channel is open, and when the second closing device contacts the second stop, the second connecting channel is closed.

16. The conveying device according to claim 13, wherein the first closing device is configured to be axially displaceable in the cylinder by a pressure stroke and a suction stroke, and wherein in the pressure stroke, the first closing device closes the first connection channel, and in the suction stroke, the first closing device opens the first connection channel.

17. The conveying device according to claim 13, wherein the second connecting channel is disposed in the pump tappet.

18. The conveying device according to claim 13, wherein the second dosing device surrounds at least a portion of the pump tappet in the form of a ring or sleeve.

19. The conveying device according to claim 13, further comprising two parts rotatable relative to each other, and a transmission for converting a rotation of the two parts in relation to one another into an axial movement of the pump tappet.

20. The conveying device according to claim 19, wherein the transmission comprises a cam guided by a guide curve running along a closed path.

* * * * *